US007200996B2

(12) United States Patent
Cogswell et al.

(10) Patent No.: US 7,200,996 B2
(45) Date of Patent: Apr. 10, 2007

(54) STARTUP AND CONTROL METHODS FOR AN ORC BOTTOMING PLANT

(75) Inventors: Frederick James Cogswell, Glastonbury, CT (US); Pengju Kang, Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 252 days.

(21) Appl. No.: 10/840,775

(22) Filed: May 6, 2004

(65) Prior Publication Data

US 2005/0247056 A1 Nov. 10, 2005

(51) Int. Cl.
*F01K 25/06* (2006.01)

(52) U.S. Cl. ..... 60/651; 60/660; 60/66; 60/667; 60/671

(58) Field of Classification Search ..... 60/651, 60/653, 660, 666, 667, 671
See application file for complete search history.

(56) References Cited

U.S. PATENT DOCUMENTS

| | | | | |
|---|---|---|---|---|
| 3,271,960 | A * | 9/1966 | Brunner | 60/653 |
| 4,007,596 | A * | 2/1977 | Braytenbah et al. | 376/211 |
| 4,208,882 | A * | 6/1980 | Lopes et al. | 60/653 |
| 4,213,304 | A * | 7/1980 | Morse | 60/664 |
| 4,425,762 | A * | 1/1984 | Wakamatsu et al. | 60/646 |
| 5,517,424 | A * | 5/1996 | Marcelle et al. | 700/287 |
| 5,724,833 | A | 3/1998 | Devers | |
| 2002/0108372 | A1 | 8/2002 | Bronicki | |
| 2003/0213245 | A1 | 11/2003 | Yates et al. | |

FOREIGN PATENT DOCUMENTS

| | | |
|---|---|---|
| EP | 1323990 | 7/2003 |
| GB | 285374 | 2/1928 |
| GB | 2405458 | 3/2005 |
| JP | 02188605 | 7/1990 |
| WO | WO 03/029619 | 4/2003 |
| WO | WO 03/031775 | 4/2003 |

* cited by examiner

*Primary Examiner*—Hoang Nguyen
(74) *Attorney, Agent, or Firm*—Marjama & Bilinski LLP

(57) ABSTRACT

The invention is a system and method for smoothly starting and controlling an ORC power plant. The system comprises a cascaded closed loop control that accounts for the lack of relationship between pump speed and pressure at startup so as to control pump speed and pressure, and that smoothly transitions into a steady state regime as a stable operating condition of the system is attained. The cascaded loop receives signals corresponding to a superheat setpoint, a pressure at an evaporator exit, and a temperature at an evaporator exit, and controls the pump speed and pressure upon startup to provide smooth operation. The system and method can further comprise a feed-forward control loop to deal with conditions at start-up and when external disturbances are applied to the ORC power plant.

3 Claims, 9 Drawing Sheets

STARTUP AND CONTROL METHODS FOR AN ORC BOTTOMING PLANT

CROSS-REFERENCE TO RELATED APPLICATIONS

This application is related to co-pending U.S. patent application Ser. No. 10/839,914, filed on even date herewith, entitled "A Method for Synchronizing an Induction Generator of an ORC Plant to a Grid," which application is incorporated herein by reference in its entirety, and which application is subject to assignment to the same assignee as the present application.

1. Field of the Invention

The invention relates to operation of Organic Rankine Cycle (ORC) power plants in general and particularly to an ORC power plant that employs cascaded closed loop control.

2. Background of the Invention

An effective control solution is essential to the safe operation of an ORC plant. For example, at start up, there is no defined relationship between pressure and pump speed. The pump speeds up to its full speed limit trying to control superheat and pressure. This condition leads to pump cavitation and flow oscillations that destabilize the startup process. Cavitation is generally known to represent a deleterious condition that can cause damage.

There is a need for a method for starting an ORC power plant smoothly and operating it under proper control.

SUMMARY OF THE INVENTION

In one aspect, the invention relates to a closed loop control system for an ORC. The ORC comprises a pump. The control system comprises a comparator that compares a superheat setpoint input and a calculated superheat value input, and provides a superheat error signal; a superheat controller responsive to the superheat error signal, the superheat controller providing a superheat control signal; an adder that adds the superheat control signal and a pressure signal, and provides a summed signal; a range limiter that accepts as input the summed signal, and produces a range limited signal within a limit range; a subtractor that subtracts from the range limited signal a duplicate of the pressure signal, the subtractor providing as output a subtracted signal; and a pressure controller that accepts the subtracted signal and produces in response thereto a pressure control signal. The closed loop control system controls a superheat of the ORC when the range limited signal is below a maximum value of the limit range, and the closed loop control system controls a pressure of the ORC when the range limited signal is at a maximum value of the range limit.

In one embodiment, in response to a determination that the pump is operating in a flow-limited regime, the control system prevents the pump from increasing a rotation speed until the pressure attains the pressure limit.

In another aspect, the invention provides a method of starting an ORC. The method comprises the steps of providing a closed loop control system for an ORC, applying heat to the evaporator, the heat being applied at a fraction of the enthalpy flux desired at steady state operation; operating the pump at reduced speed; setting a high pressure limit to a value of pressure that can be achieved at steady-state at the reduced pump speed; waiting until the operating condition of the ORC attain a pressure plateau of an operating curve of the pump curve; increasing the pressure limit to a nominal operating value; operating the pump at a faster speed consistent with the increased pressure limit; permitting the operating mode of the system to switch from pressure control to superheat control at a pressure at or below the nominal operating value of the pressure limit; and increasing and controlling the heat flux to bring the system to full load.

The ORC plant comprises a pump and an evaporator having a heat input. The control system comprises a comparator that compares a superheat setpoint input and a calculated superheat value input, and provides a superheat error signal; a superheat controller responsive to the superheat error signal, the superheat controller providing a superheat control signal; an adder that adds the superheat control signal and a pressure signal, and provides a summed signal; a range limiter that accepts as input the summed signal, and produces a range limited signal within a limit range; a subtractor that subtracts from the range limited signal a duplicate of the pressure signal, the subtractor providing as output a subtracted signal; and a pressure controller that accepts the subtracted signal and produces in response thereto a pressure control signal.

In yet another aspect, the invention features a method of controlling a condensing temperature of an ORC. The method comprises the steps of providing an ORC comprising a condenser and a fan for cooling the condenser with air; measuring a condensing temperature of a working fluid employed in the ORC; computing an output value using a linearized function of the condensing temperature and an ambient air temperature; comparing the output value with a setpoint value generated using the linearized function to create an error signal; operating on the error signal with a controller to generate a control signal; and applying the control signal to the fan to control an amount of air applied to the condenser for cooling.

In one embodiment, the step of measuring a condensing temperature of a working fluid employed in the ORC comprises measuring the temperature on working fluid at an exit of the condenser. In some embodiments, the method further comprises the steps of estimating a refrigerant mass flow rate in the condenser using a pressure at a high pressure side of a turbine; and providing in a feed-forward manner the estimated refrigerant mass flow rate to a temperature controller to control a temperature of the condenser. In some embodiments, the method is applied at a selected one of a start-up time of the ORC plant and a time when the ORC plant experiences external disturbances.

In yet another aspect, the invention features a method of damper override control. The method comprises the steps of defining a specified safety limit; checking a refrigerant vapor temperature at an evaporator exit; and activating a damper control when the refrigerant vapor temperature at the evaporator exit exceeds the specified safety limit; whereby an excess amount of heat from a heat source is diverted until the refrigerant vapor temperature at the evaporator exit falls below the specified safety limit. In some embodiments, the damper control operates in a selected one of open loop control and closed loop control.

The foregoing and other objects, aspects, features, and advantages of the invention will become more apparent from the following description and from the claims.

BRIEF DESCRIPTION OF THE DRAWINGS

The objects and features of the invention can be better understood with reference to the drawings described below, and the claims. The drawings are not necessarily to scale, emphasis instead generally being placed upon illustrating the principles of the invention. In the drawings, like numerals are used to indicate like parts throughout the various views.

DETAILED DESCRIPTION OF THE INVENTION

Figure 1:
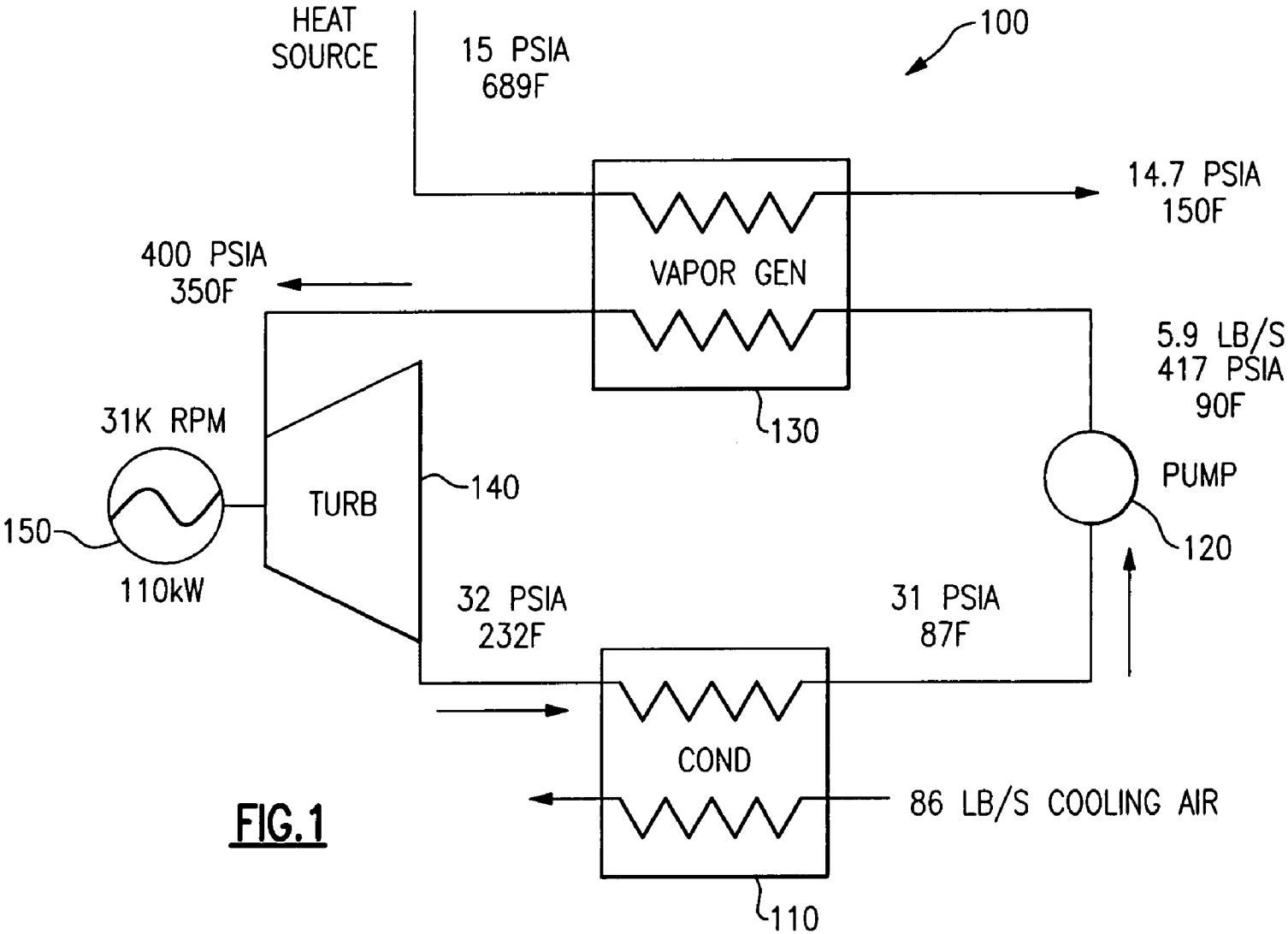
FIG. 1 is a schematic diagram that illustrates an exemplary embodiment of the ORC power plant according to the invention.

The Organic Rankine Bottoming Cycle (ORC) may be added to a distributed generation system to increase its overall efficiency. The ORC does not consume fuel directly, but uses the waste of the "prime-mover," which may be a micro-turbine or reciprocating device or other heat source. An ORC closed-loop control logic should be effective both during plant startup and during normal operation. FIG. 1 shows a schematic 100 of the ORC device. The primary components are the condenser 110, a refrigerant pump 120, an evaporator 130, an optional recuperator (not shown in FIG. 1) and a turbine 140-generator 150 set. In the embodiment discussed herein, the working fluid is 1,1,1,3,3-pentafluoropropane (known as R245fa), which is available from the Honeywell Corporation or E. I. DuPont DeNemours and Company.

Both system efficiency and reliability benefit from maintaining the proper refrigerant (or working fluid) condition entering the turbine. In the ORC embodiment, a variable speed pump is the primary actuator used to control the refrigerant condition. Throughout the operating envelope the following criteria should be maintained at the entrance to the turbine 140 to ensure system reliability:

1. The maximum pressure limit should not be exceeded;
2. The maximum temperature limit should not be exceeded; and
3. The superheat should not approach zero.

Figure 2:
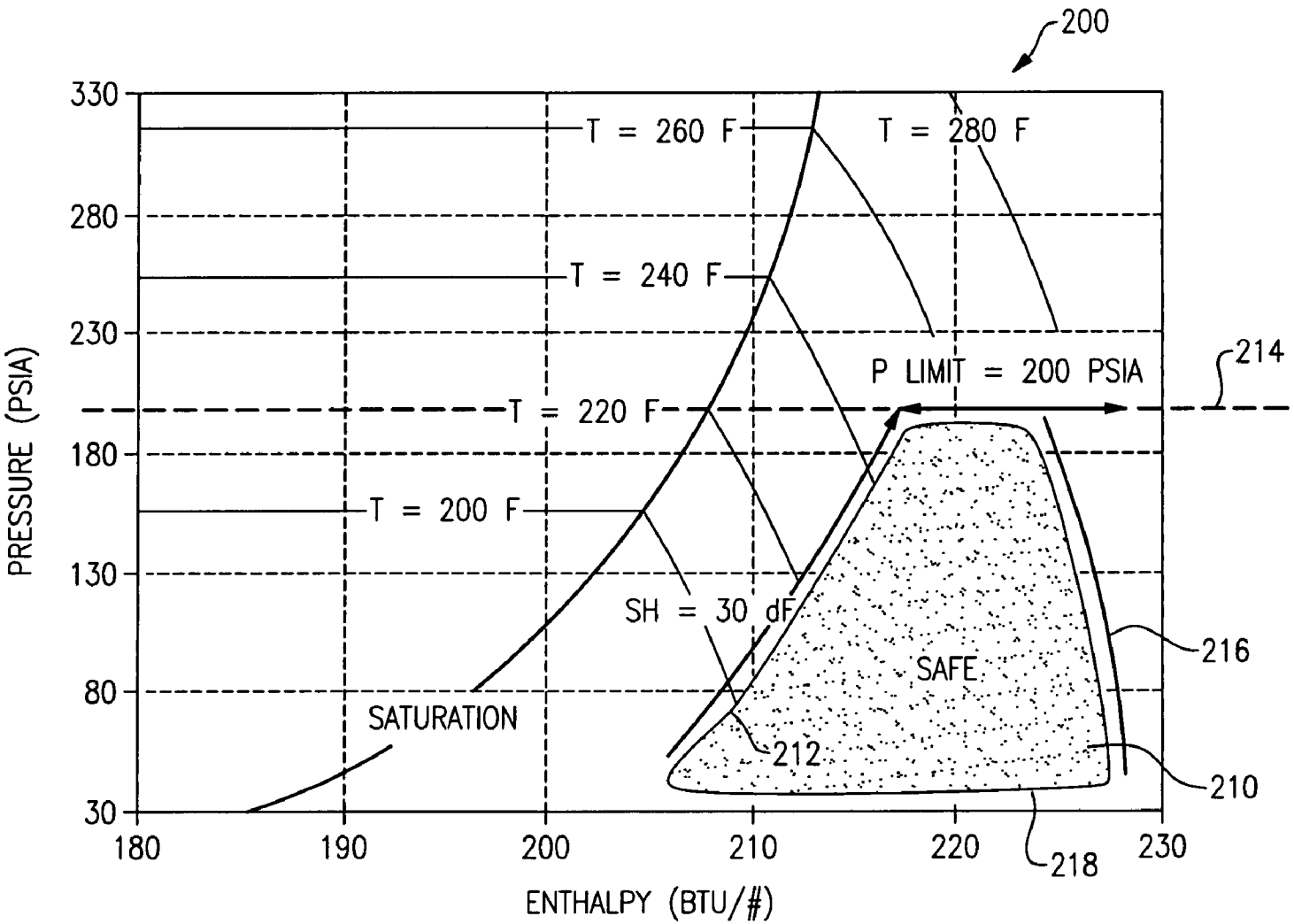
FIG. 2 is a thermodynamic pressure-enthalpy (PH) diagram showing the safe operation range of the ORC plant, according to the invention.

FIG. 2 is a diagram 200 showing a safe operation range 210 on the thermodynamic pressure-enthalpy (PH) diagram for one embodiment of the invention. The safe operating range is bounded by a superheat curve 212, a high pressure limit 214, a temperature limit 216, and a minimum pressure 218 below which the pump 120 operates unacceptably. In addition to the above criteria, the controls should drive the operation state to the high pressure limit in order to maximize the power efficiency of the system. Under normal circumstance, there is no minimum pressure limit for the pump, but there may be a minimum pressure for evaporator/pump operation stability.

The primary objective of startup control is to bring the system to steady state control condition through transitional control logic. The present disclosure discusses methods used during system startup. The ORC control system that facilitates smooth startup is described in the following sections.

Control System Requirements

The control system design is driven by a combination of functional requirements, cost constraints, and reliability issues. The mechanisms available to actively manipulate the ORC system are the pump and condensing fan speed, which are used respectively to regulate the superheat at the evaporator exit and the condensing pressure of the condenser. An important objective is to make the entire plant deliver a desired amount of net power as efficiently as possible. The control system performs the high level tasks of performance optimization, transient behavior regulation, and fault detection and mitigation. Important requirements for the control system are:

1. Maintaining superheat close to the specified set point value;
2. Constraining the pump speed to control the vapor pressure and temperature at the evaporator exit to values that do not exceed the pre-specified limits to maintain the integrity of refrigerant properties; and
3. Regulating the condensing temperature to attain the proper turbine low side pressure requirements.

There are three major closed loop control systems that are essential to the proper operation of the ORC plant. They are a superheat control, a condensing temperature control, and a damper control. The damper control diverts hot air away from the evaporator to control the vapor temperature at the evaporator exit within the designed limit. In some embodiments, the control of the damper and the superheat are coordinated so that the maximal amount of heat is used without endangering the evaporator and turbine, so as to use the heat source efficiently.

Evaporator Superheat Control

Figure 3:
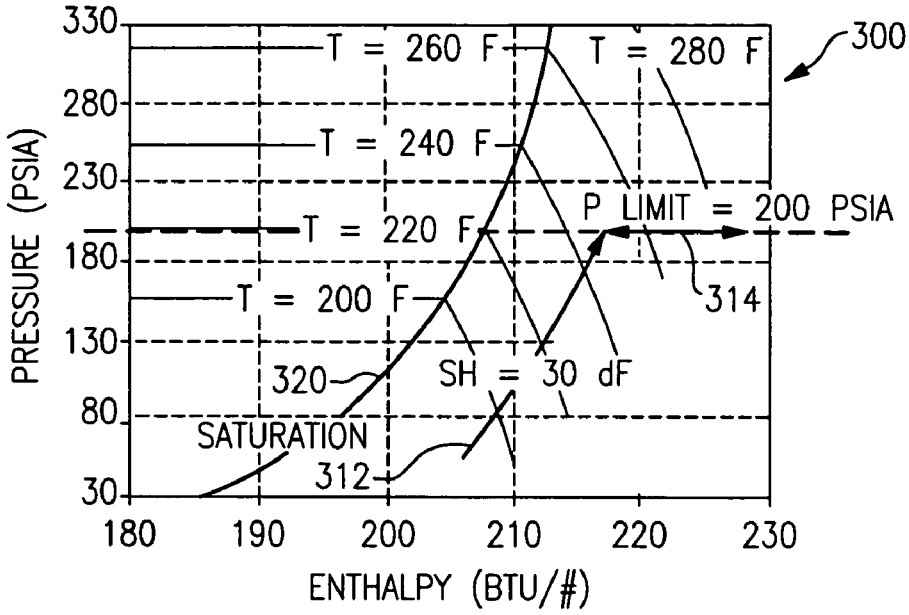
FIG. 3 is a diagram showing a superheat trajectory line, according to principles of the invention.

The working liquid at the turbine inlet is superheated to obtain safe operation of the turbine. With regard to power optimization, a lower superheat requires the pump to deliver more mass flow into the evaporator, thus increasing the power output of the turbine. However if the superheat setpoint is set too low, the overshoot of the superheat under closed loop control may cause the superheat to drop below zero. The entire system under minus (negative) superheat does not shut down immediately. Instead, it goes from the turbine mode to bypass mode. If the system regains superheat control within a specified time window, it goes back to turbine mode FIG. 3 is a diagram 300 showing a superheat trajectory line 312 corresponding to a superheat of 30 degrees Fahrenheit (designated 30 dF). If the trajectory line passes over the saturation line 320 of the thermal dynamic cycle, the entire system will be shut down for safety reasons. This safety requirement is represented by a specification of a constraint for the superheat control system, which requires that superheat remain above zero under disturbances.

The control requirements for superheat control are explained in the thermal dynamic cycle diagram of the ORC. As the ORC power plant comes on-line, or as the hot air heat flux increases, the pressure rises at constant superheat (e.g., 30 dF in the example shown). When the design pressure 314 is reached (e.g., 200 psia in the example shown), a hold is placed on the output of the controller to maintain this pressure. In some embodiments, there is a pressure relief setpoint (for example, 235 psia) and there is a control alarm setpoint (for example, 225 psia). As the heat flux changes the superheat, measured as the exit temperature, changes. If the heat flux continues to increase, the temperature of the working fluid at the evaporator exit (TEVAPEX), T, increases. In some embodiments, for example at a superheat of 50 dF, the hot evaporator exit temperature of the working fluid causes an override control to be activated. This override control in some embodiments is the damper control that causes excessive hot air from the evaporator to be diverted.

In some embodiments, at 70 dF superheat (290 F) the unit is shut down, and an alarm condition is activated. This will occur if the TEVAPEX and superheat climb toward an upper limit and threaten to exceed that limit. In some embodiments, if the heat flux decreases to the point where the superheat is below 30 dF due to the active control of the hot air damper, the hold is released and the control once again controls superheat.

The heat flow from the heat source may change, independently of the control of the ORC plant controller. If the heat flow decreases, the superheat will decrease; to match this decrease in superheat, the pump 120 has to reduce its flow rate to cause the superheat to return to the desired condition. The operation of the turbine 140 can be seriously impacted if the flow rate is too low. In some embodiments, in such a case, the system will be shut down. On the other hand, the heat flux may increase for some reason, again independently of the operation of the ORC plant controller. In this case, the superheat will increase. To balance the increase in superheat, the pump 120 has to increase its speed to deliver more liquid into the evaporator 130 to cause the superheat to return to the desired condition. As the pump speed directly controls the pressure, the increase in flow rate will cause the vapor pressure at the evaporator exit to increase. There is a maximum working pressure allowed for the evaporator (e.g., 210 psia for an embodiment described herein). While the above zero superheat constraint can be handled by tuning the controller to have a minimum overshoot, the pressure constraint may not be easily dealt with through tuning the controller. Traditionally this constraint is normally handled using some kind of overriding logic, which takes over the operation of the closed loop controller.

Figure 4:
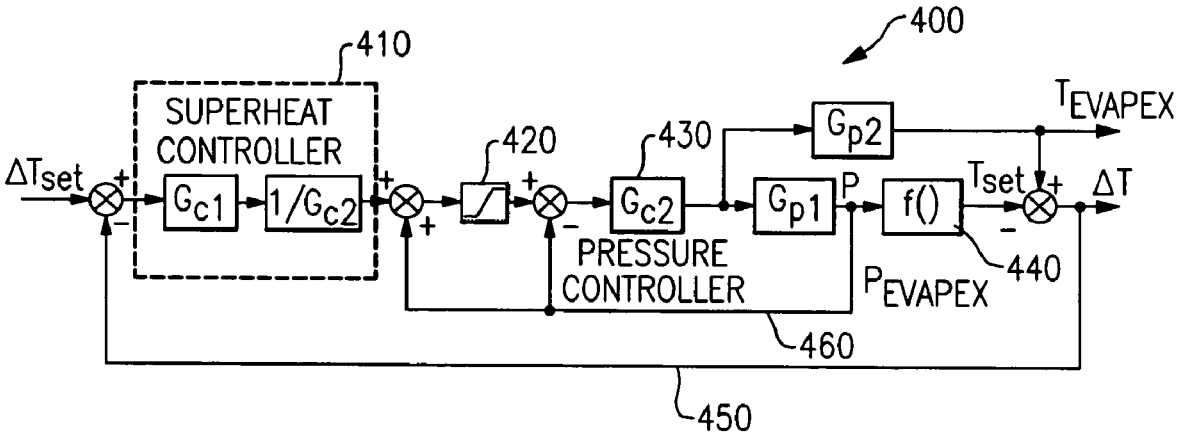
FIG. 4 is a diagram showing a transfer function in block diagram format of the cascaded closed loop control system and methodology, according to principles of the invention.

The transfer function in block diagram format 400 is shown in FIG. 4. The diagram 400 comprises a superheat controller 410, a range limiter 420, and a pressure controller 430. The diagram further comprises a calculation module 440, outer feedback loop 450, and inner feedback loop 460. Calculation module 440 can be any convenient calculator, such as a programmable general purpose CPU with software recorded in an associated machine-readable memory, or a dedicated computation module. The mathematical terms involved in the transfer function are indicated for the various components. $G_{p1}$ is the transfer function of vapor pressure (PEVAPEX), P, at the evaporator outlet as a function of refrigerant liquid flow rate. $G_{p2}$ is the transfer function of TEVAPEX as a function of refrigerant liquid flow rate. PEVAPEX is the Pressure at the EVAPorator EXit, while TEVAPEX is the Temperature at the EVAPorator EXit. ΔT is the measured superheat temperature. $\Delta T_{set}$ is the set-point value for superheat . The saturated temperature ($T_{sat}$) is calculated by module 440 using a nonlinear function, f( ), which is related to the properties of the refrigerant used in the ORC.

The superheat (ΔT) in the vapor is defined according to:

$$\Delta T = T - T_{sat} \qquad \text{equation (1)}$$

$T_{sat}$ is a non-linear function of P:

$$T_{sat}[F] = f(P) = A\ln(P+B) + C \qquad \text{equation (2)}$$

where ln indicates a logarithm using the natural base e, and P is the evaporator exit pressure, PEVAPEX. In one embodiment, if P<150 psia, then A=65.98, B=6.777, and C=−144.13; however, if P>=150 psia, then A=111.45, B=65.175, and C=−402.65.

The output of the superheat controller 410 (combination of $G_{c1}$ and $1/G_{c2}$) serves as the setpoint for the secondary pressure controller 430 having transfer function $G_{c2}$. The disturbances caused by the change of hot air condition will be quickly suppressed by the inner loop controller and will not be carried further through the superheat process. Parameter variations and nonlinearities in inner loop will be suppressed by the inner loop controller, making it possible to achieve much better control in the outer loop.

Due to the introduction of an element that is the inverse of $G_{c2}$ ($1/G_{c2}$), the transfer function of the superheat controller 410 becomes $G_{c1}/G_{c2}$. Therefore, with regard to $G_{c1}$, the $G_{c2}$ that is fed back along loop 450 is actually canceled out. If $G_{c1}$ and $G_{c2}$ are selected as PI (proportional and integral) controllers:

$$G_{c1}(s) = \frac{Kp_1 s + Ki_1}{s},\ G_{c2}(s) = \frac{Kp_2 s + Ki_2}{s} \qquad \text{equation (3)}$$

where $K_{p1,2}$ and $Kl_{1,2}$ are proportional and integral constants.

Then equation (4)

$$G_{c1}(s)/G_{c2}(s) = \frac{Kp_1 s + Ki_1}{s}\frac{s}{Kp_2 s + Ki_2} = \frac{\frac{Kp_1}{Ki_1}s + 1}{\frac{Kp_2}{Ki_2}s + 1}\frac{Ki_2}{Ki_1}$$

If we set $\frac{Kp_1}{Ki_1} = \frac{Kp_2}{Ki_2}$, then $G_{c1}(s)/G_{c2}(s) = \frac{Ki_2}{Ki_1} = kp$, which means the superheat controller 410 becomes a proportional controller, thus solving the integrator saturation problem. Theoretically $G_{c2}$ may still be saturated, due to the limits imposed on the actuator, but for the ORC application, the upper pressure is the primary concern. The pump speed is reduced to maintain the pressure below this upper pressure limit. Reducing the pump pressure will not cause the integrator to be saturated. Consequently, this cascade scheme greatly improves the performance of the control system.

Pump Characteristics

Figure 5A:
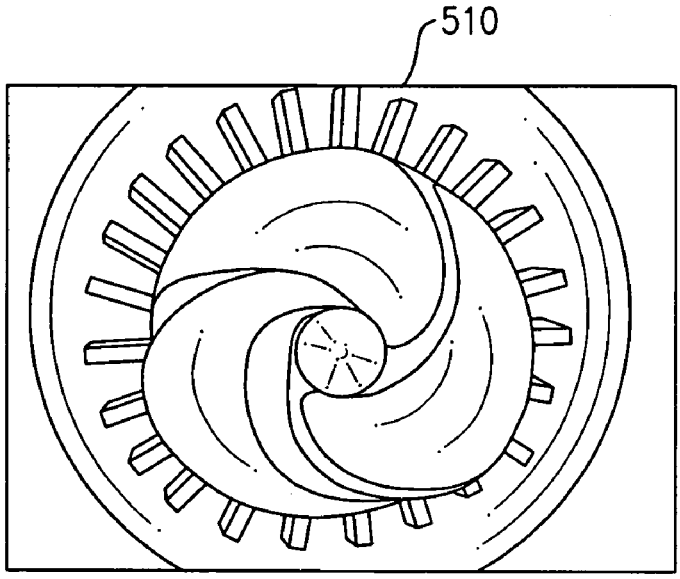
FIG. 5A is a view of the impeller of a pump used in one embodiment of the invention.
Figure 5B:
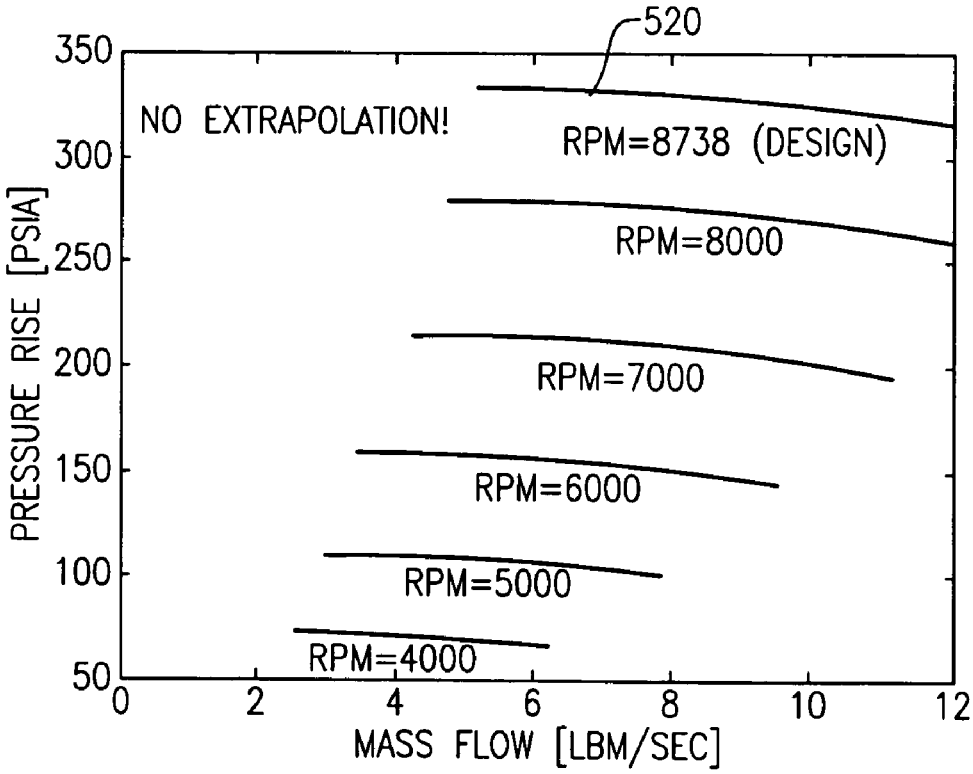
FIG. 5B shows performance curves for the pump shown in FIG. 5A, according to the manufacturer.

FIG. 5A is a view of the impeller 510 of a pump used in one embodiment of the invention. FIG. 5B is a diagram that shows performance curves 520 for the pump shown in FIG. 5A according to the manufacturer. This type of pump is designed to be used as a nearly constant-pressure source; for a given speed it provides a large range of flow at nearly constant pressure. The curves of FIG. 5B do not show what happens when the system pressure is greater or less than the "pressure plateau." If the system pressure is greater than the pressure plateau the flow goes to zero (or even becomes negative, i.e., the flow direction reverses.) If the system pressure is less than the plateau value the flow reaches a maximum value and becomes relatively insensitive to system pressure (as long as the pressure is below the pressure plateau value.) In this region the pump acts as a "flow source." This is not the regime where this type of pump is designed to operate.

When using this type of pump as the primary actuator for evaporator exit condition control, the dynamics of the system are completely different depending upon whether the pump is in the constant pressure or constant flow region.

For a particular ORC system, the pump is sized so that at steady-state it is operating on the pressure plateau.

ORC System Dynamics

Figure 6A:
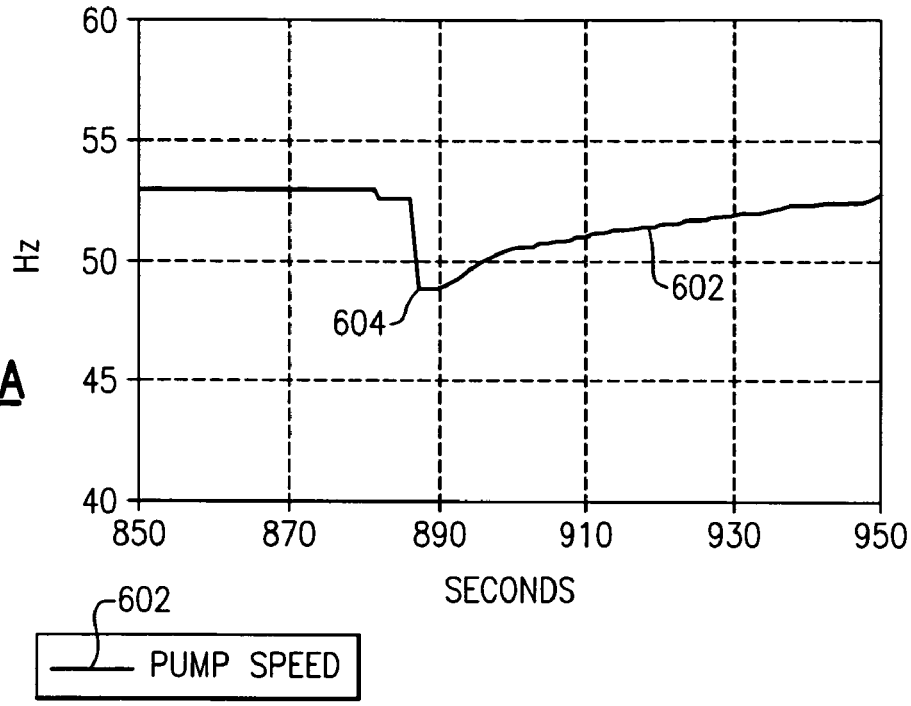
FIG. 6A is a diagram showing the relationship between pump speed and time, wherein a temporary drop in pump speed is experienced.
Figure 6B:
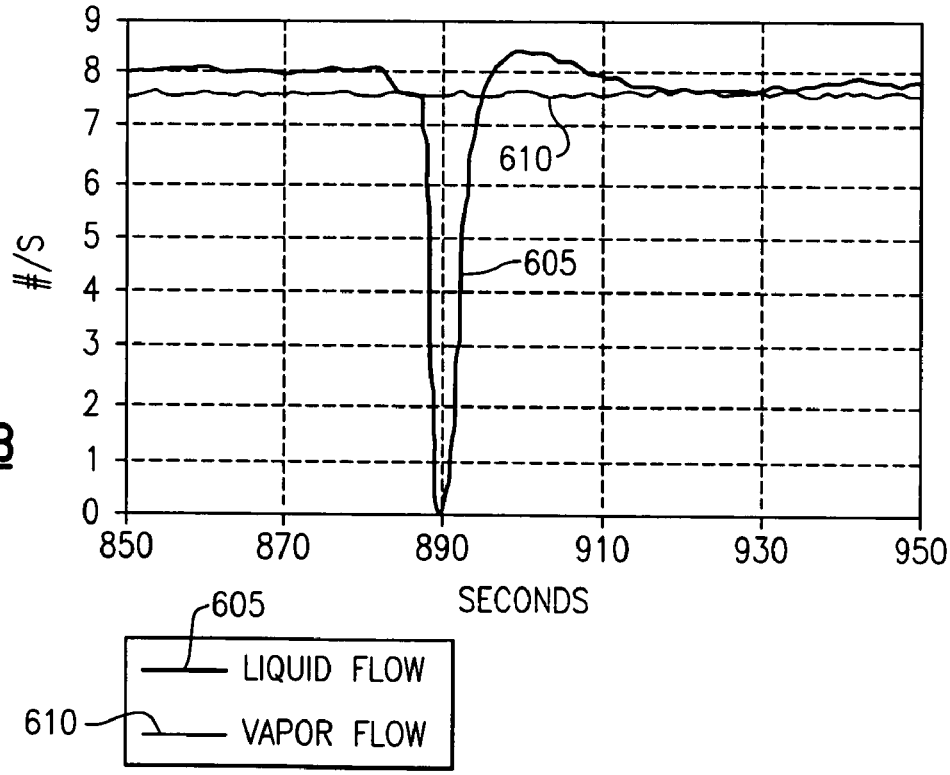
FIG. 6B is a diagram showing the response of liquid flow and vapor flow to the temporary drop in pump speed of FIG. 6A.

For a static system the pressure changes "instantly" as the pump speed changes. Many practical systems can be treated as static. However, the ORC system, as shown in FIG. 1, cannot be treated as static. The evaporator 130 and condenser/receiver 110 act as capacitances to system pressure and temperature. The high-side pressure is a state-variable of the evaporator. When the pump speed changes, the system pressure does not change instantly, but must integrate to its new value. FIGS. 6A and 6B demonstrate this behavior. FIG. 6A is a diagram showing the relationship 602 between pump speed and time, wherein a temporary drop 604 in pump speed is experienced. FIG. 6B is a diagram showing the response of liquid flow 605 and vapor flow 610 to the temporary drop in pump speed of FIG. 6A. A small drop 604 in the pump speed results in a momentary complete loss of liquid flow, while the vapor flow remains unchanged.

Dynamics During Start-up

When the ORC system is off line, the pressures have equalized at a pressure that is determined by the coldest large volume of the system. When the pump is first turned on, its head pressure is nearly zero. The head cannot increase until the refrigerant is transported to the evaporator, and the heat applied to the evaporator boils the refrigerant. During this initial phase of startup, the pump is acting as a constant flow device, because its pressure is below the pressure plateau where it is designed to run.

A startup method has been developed that controls the pump speed to prevent over-speed and flow oscillations, and provides a smooth transition to superheat control.

Figure 7:
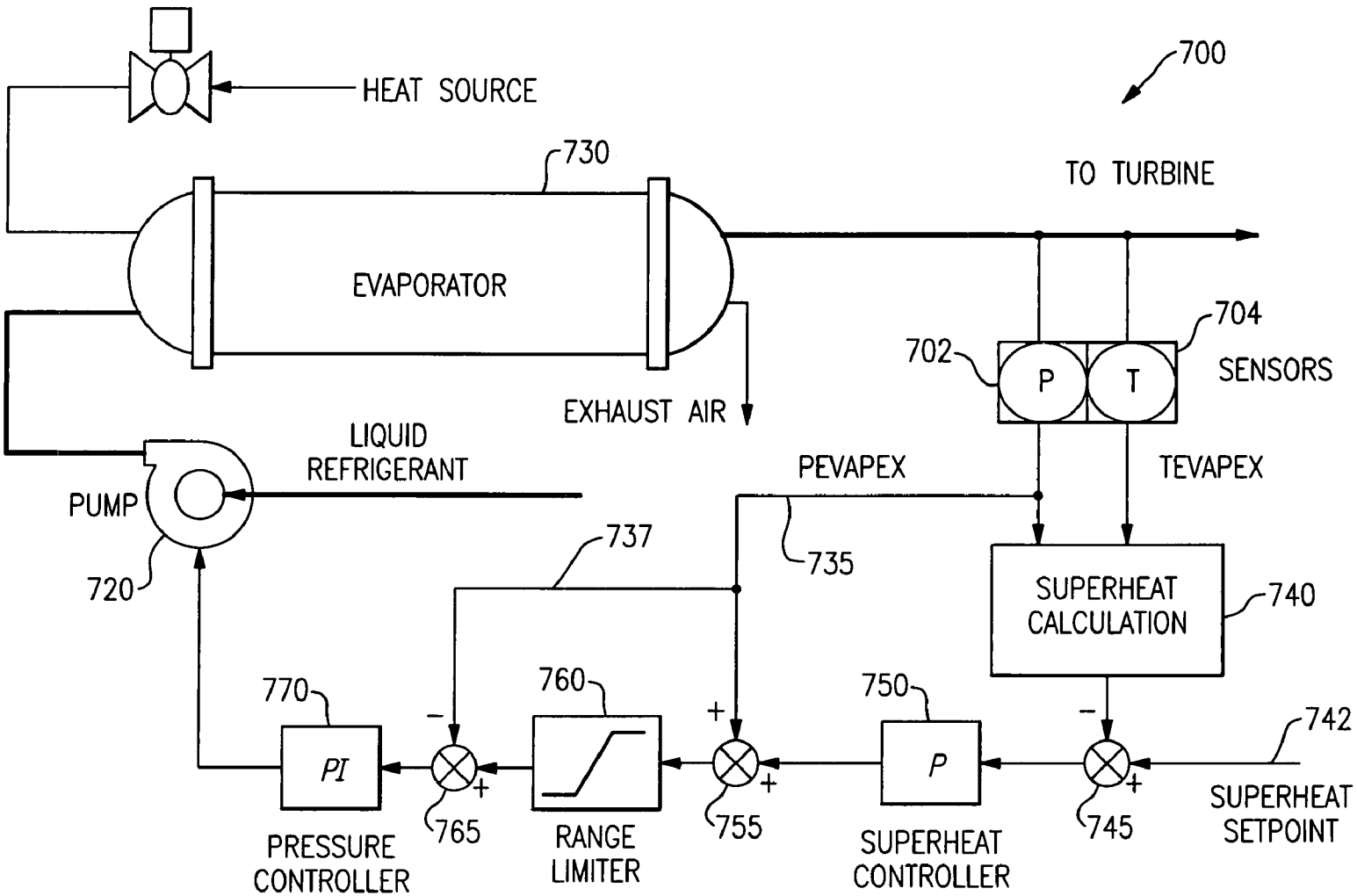
FIG. 7 is a diagram illustrating an embodiment of the cascaded closed loop control system and method, according to the invention.

FIG. 7 is a diagram 700 illustrating an embodiment of the cascaded closed loop control system and methods. The diagram can be understood to show the components and their interconnections in the illustrative apparatus that embodies the invention. Equally, the diagram can be understood to represent the methods of the invention, and to indicate the flow of information and how that information is processed in order to carry out the methods of the invention.

A technique that can handle the superheat and pressure constraints in a smooth way is described, according to principles of the invention. The inventive cascade scheme is given in FIG. 7, in which a positive pressure feedback signal 735 is introduced in an adder 755 before a negative pressure feedback signal 737 is introduced using a subtractor 765. The positive pressure feedback and the negative pressure feedback signals are introduced on opposite sides of a range limiter 760, and in some embodiments are copies of the same signal generated by a pressure sensor 702. In this way, as long as the pressure is within the constraint limit, the two feedback signals cancel each other, making the pressure controller an open loop control. As soon as the pressure reaches its limits, the closed loop pressure effectively regulates the pressure around the limit.

The control system has as inputs a pressure signal PEVAPEX measured with a pressure sensor P 702 and a temperature signal TEVAPEX measured with a temperature sensor T 704. A computation unit 740, which for example is a programmed general purpose computer, or alternatively is a dedicated CPU employing a computer program, computes a value of superheat based on PEVAPEX and TEVAPEX. There is also an input port 742 for providing a value representing a superheat setpoint, which input value can be provided by any of a manual control, a programmed general purpose computer, or a remote controller device, such as an industrial controller.

There are two feedback loops. The outer loop is a feedback of evaporator superheat. The superheat setpoint value and the calculated value of superheat are compared in a comparator 745, which provides an error signal. The error signal is communicated to a superheat controller 750 that provides an output signal to the summing circuit 755. The inner loop is a feedback of evaporator exit pressure. In this method, a pressure feedback signal corresponding to PEVAPEX is added to the superheat controller output in the summer circuit 755, before the limit is applied by a range limiter 760, and the same pressure value is subtracted after the limit, using a subtraction circuit 765. A pressure controller 770 acts on the signal so computed, and provides a control signal to the pump 720. If the pressure is within the bounds of the limit, then this pressure feedback is cancelled out because the amount added is equal to the amount later subtracted. The "cascade" system then operates as a simple Proportional, Integral, and Derivative (PID) controller on superheat. If the pressure reaches a limit, then the superheat loop is disconnected, and the PID acts on pressure.

Using this control loop method, three modes of operation are possible:

1. Closed loop PID control on superheat;
2. Closed loop PID control on pressure; and
3. Open loop control on pump speed.

When in closed loop operation, the pressure/superheat transition occurs seamlessly. When in open loop operation, the control algorithm is not called, and the pump speed is held constant or is set by other logic. Open loop operation implies that all of the feedback signals are unused, which can be accomplished in any of several ways, such as turning off all of the feedback components; disconnecting the output of the last components (e.g., the pressure controller); or turning off power to all of the summing and subtracting circuits, thereby providing signals having a null or zero input-value to each control component (e.g., superheat controller, range limiter, and pressure controller) so that each controller provides a null output. In open loop operation, a control command is directly sent to the pump inverter to adjust the pump speed to control one or more plant variables, such as superheat.

Using this control method, the pressure limits may be varied dynamically to move the system operation from one regime to another. The startup method transitions from open loop superheat control to closed loop, and then varies the pressure limits to slowly increase the operation pressure. Compare the pressure limits of the "safe region" of FIG. 2 with the pressure plateaus of FIG. 5B. The pump is a pressure source. The higher the speed of the pump, the higher the pressure of the vapor exiting the evaporator. Too high a pressure can endanger the integrity of the turbine. This high pressure limit is set according to the turbine design. The method includes the steps of:

- applying hot air to the evaporator, for example at approximately half the design enthalpy flux;
- turning on the pump at reduced or minimum speed, for example 15 Hz;
- setting a high pressure limit to a value of pressure that can be achieved at steady-state at the initial low pump speed, for example 70 psia;
- waiting until the operating conditions come to the pressure plateau of the pump curve, for example as determined from calculations using a mathematical model;
- ramping up the pressure limit to its normal value, such as 280 psia;
- permitting the mode to switch from pressure control to superheat control at a pressure at or below the desired pressure limit, such as 280 psia; and
- increasing and controlling the hot air enthalpy flux to bring the system to full load, defined as maximum pressure and temperature at the evaporator exit.

Figure 8A:
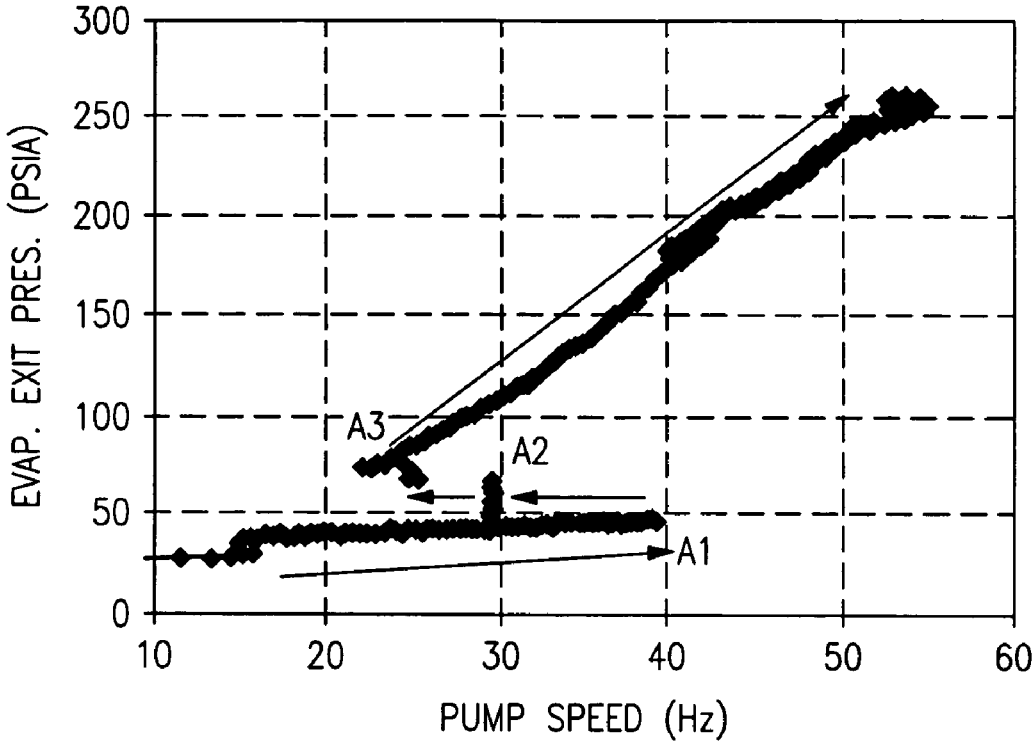
FIG. 8A is a diagram illustrating an operating example in which no start-up hold is employed, according to principles of the invention.
Figure 8B:
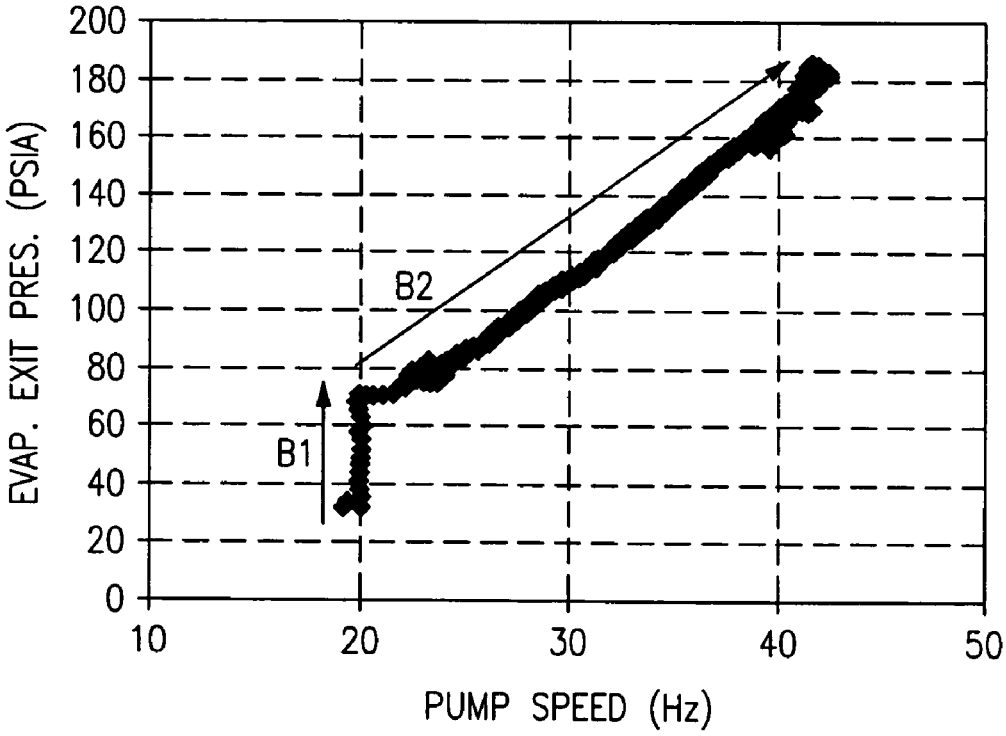
FIG. 8B is a diagram illustrating an operating example in which a start-up hold is employed, according to principles of the invention.

Two operating example are illustrated in FIGS. 8A and 8B. In FIG. 8A the superheat control loop was closed once the superheat value exceeded its setpoint. Since the pump was still on the flow-limited part of its curve, the pump speed increased continuously (arrow A1) with no effect on the system pressure or superheat. The loop was opened, and the pump speed was manually reduced in two steps (arrows A2). The loop was closed when the system pressure was sufficiently high so that the pump was operating on its pressure plateau. At that time, the operating condition of the system was under control. The high pressure limit value was ramped from 70 psia to 280 psia (arrow A3). During this time the control mode switched smoothly from pressure control to superheat control. In FIG. 8B the pump speed was held at 20 Hz until the pressure plateau was achieved (arrow B1). The loop was closed and the high-pressure limit was ramped in a manner similar to that of FIG. 8A (arrow B2). Operation according to FIG. 8B prevented pump overspeed.

Feedforward and Feedback Condensing Temperature Control

The system also comprises a feedback-feedforward control that accounts for the nonlinearities in the dynamics of condensing process, as well as the large transients occurring during startup so as to ensure a smooth condensation of the vapor refrigerant. The feedback-feedforward portion of the control receives signals corresponding to a condensing temperature, outdoor ambient temperature, and the working fluid mass flow rate, and controls the inverse of the difference between condensing temperature and ambient temperature to guarantee smooth system operation during startup or under external large disturbances.

Modeling

Figure 9:
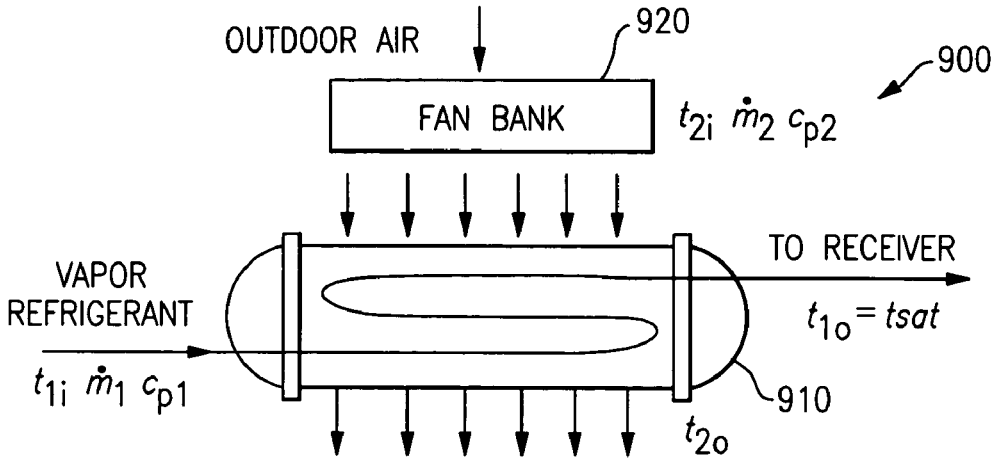
FIG. 9 is a diagram that shows the heat transfer process of a condenser useful in practicing the invention.

FIG. 9 is a diagram 900 that shows the heat transfer process in a condenser 910. Air flow is provided by a fan bank 920, comprising one or more fans that move ambient air across the condenser 910. The steady state heat transfer function for a condenser (with no sub-cooling) is approximated as Effectiveness: equation (5)

$$\frac{t_{2o}-t_{2i}}{tsat-t_{2i}} = 1-\exp\left(-\frac{UA}{m_1 c_{pl}}\right)$$

Energy Balance:

$$\dot{m}_2 c_{p2}(t_{2o}-t_{2i}) = \dot{m}_1 \Delta h_1$$

where tsat is the saturation temperature of the refrigerant in the condenser; $t_2$i is the outdoor air temperature; $t_{2o}$ is the air temperature leaving the condenser coil; U is the overall heat transfer coefficient; A is the heat transfer area; $\dot{m}_1$ and $\dot{m}_2$ are the mass flow rates of refrigerant vapor and air; $c_{p2}$ is the specific heat of the air; and $\Delta h_1$ is the change in enthalpy of the refrigerant stream from vapor to saturated liquid. Sub-cooling is not present in steady state when a receiver is used after the condenser, but may present during transient conditions.

The above equations can be combined to the following form where the air flow rate can be solved for a given refrigerant enthalpy load, $\dot{m}_1\ \Delta h_1$; outside air temperature, $t_{2i}$; and desired condensing temperature, tsat.

$$\dot{m}_2 c_{p2}\left(1-\exp\left(-\frac{UA}{\dot{m}_1 c_{pl}}\right)\right) = \frac{\dot{m}_1 \Delta h_1}{tsat-t_{2i}} \quad \text{equation (6)}$$

The relationship between the temperature difference, tsat–$t_{2i}$, and air flow rate, $\dot{m}_2$ (directly related to fan speed f) can be approximated by an inverse function for a given enthalpy load, $\dot{m}_1\ \Delta h_1$:

$$\Delta T \approx \frac{k}{f} \quad \text{equation (7)}$$

where k is a constant, and $\Delta T = tsat - t_{2i}$.

Figure 10:
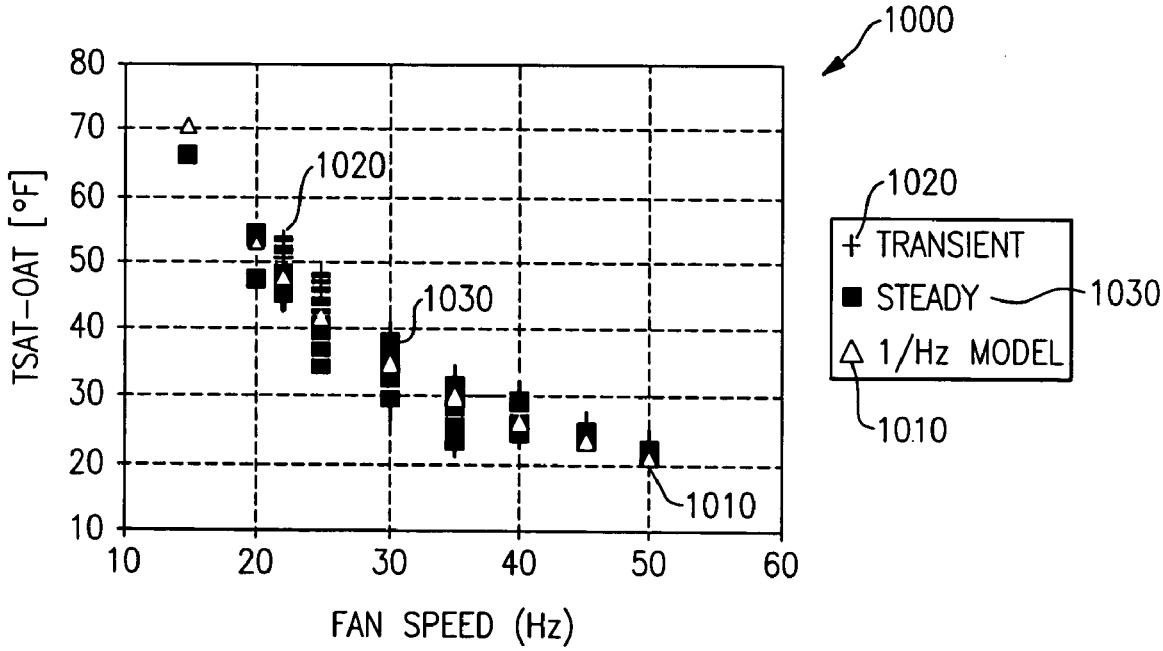
FIG. 10 shows experimental data obtained from a condenser as shown in FIG. 9.

FIG. 10 is a diagram 1000 showing the experimental data obtained from the condenser of the plant. The data shows the inverse relationship between pump speed and difference between condensing temperature (tsat) and outdoor ambient temperature (OAT), indicated as $t_{2i}$ in equations 6 and 7. The data is in good agreement with a model, shown in triangle symbols 1010. The experimental results 1020, 1030 confirm the model prediction of an inverse behavior for the change in liquid-line temperature with change in fan speed.

Control Scheme

Figure 11:
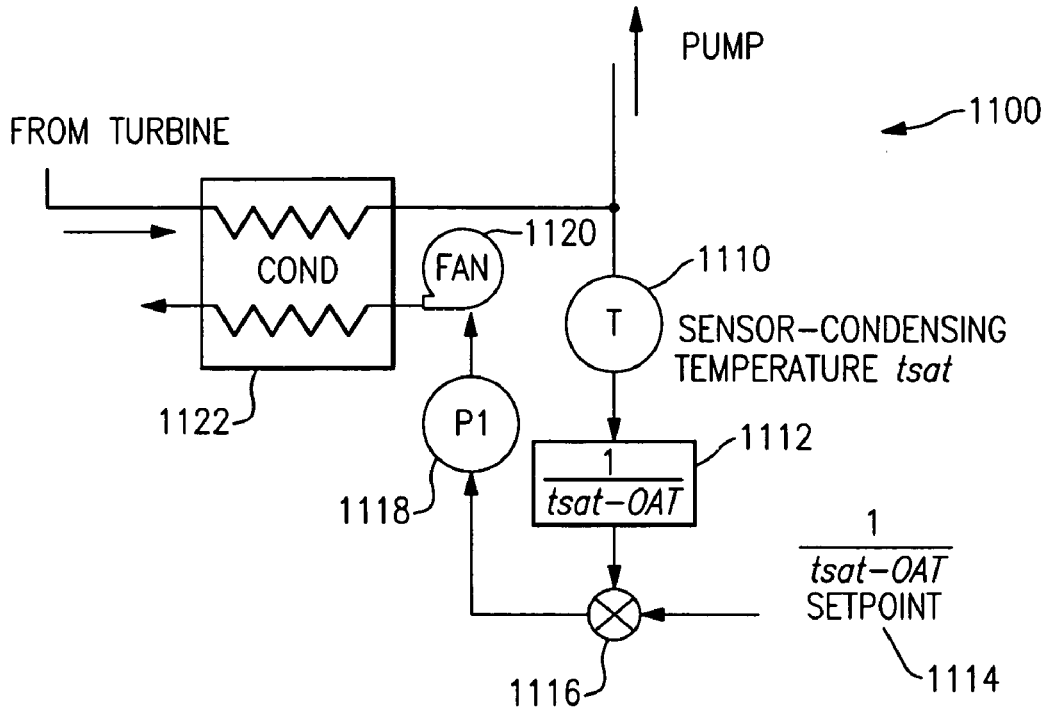
FIG. 11 is a diagram of a condensing temperature control loop useful in practicing the invention.

Using a feedback controller to control the tsat at a set point, it will be difficult to tune the controller, because the gain of the system is a nonlinear function of fan speed. One approach to this nonlinear control problem is to select tsat-$t_{2i}$ as the process variable to be controlled, and to use an inverse function in the feedback path, thereby transforming the relationship between fan speed and inverse of tsat-$t_{2i}$ to a linear relationship. Consequently, the controller can be tuned as a linear controller. This approach is a feedback linearization technique. It has been found that a PI controller works satisfactorily with this linearization technique under various ambient conditions. FIG. 11 shows a diagram 1100 of the condensing temperature control loop. The loop includes a temperature sensor 1110 that measures condensing temperature, a computation module 1112 that generates a linear transfer function, a set point input 1114 that provides an input to a comparator 1116, which in turn generates a error signal that a controller 1118 uses to operate a fan 1120 for cooling the condenser 1122.

Equation (7) assumes that the working fluid mass flow rate is constant. In extreme transient situations such as startup and shutdown, or when large flow rate disturbances occur, it is difficult for the PI controller to maintain the condensing temperature. For this reason, a feed forward plus feedback control scheme is used to regulate the condensing temperature under extreme operating conditions experienced at start up. This improved control scheme is able to maintain the condensing temperature under large mass flow rate disturbances or variations. Consequently, the pump cavitation issue is resolved. Without considering the time constant of the mass flow rate on condensing temperature, a simple linear feed forward model is developed for this control scheme.

From equation (6), we arrive at:

$$\dot{m}_2 c_{p2} = \frac{\dot{m}_1 \Delta h_1}{\left(1 - \exp\left(-\frac{UA}{\dot{m}_1 c_{pl}}\right)\right)\Delta T} \quad \text{equation (8)}$$

Next we linearize this equation around the working point. In order to maintain $\Delta T$ at a constant value, $\Delta T_{set}$, the relationship between the cooling airflow rate and the refrigerant mass flow rate has to comply the following:

$$\dot{m}_2 = k_1 \frac{\dot{m}_1}{\left(1 - \exp\left(-\frac{UA}{\dot{m}_1 c_{pl}}\right)\right)\Delta T_{set}} \quad \text{equation (9)}$$

where $k_1$ is a constant.

The mass flow rate, the average overall heat transfer coefficient and the area of the condenser where a two-phase mixture exists all vary with the operating conditions of the cycle. As an approximation, the exponent $UA/\dot{m}_1 c_{p1}$ is considered not varying significantly when the refrigerant flow rate is varying significantly. In that case the steady relationship between the cooling air flow rate and the refrigerant flow rate required to maintain a constant condensing temperature is $$\dot{m}_2 = k_2 \frac{\dot{m}_1}{\Delta T_{set}} \quad \text{equation (10)}$$

where $k_2$ is a constant.

The mass low rate of the refrigerant can be estimated from the pressure of the high side pressure (evaporator exit pressure) of the cycle, since the turbine is choked. For choked flow, the mass flow rate is in proportion to the pressure. The proportional coefficient estimated for the 100 kW ORC unit is estimated as $$\dot{m}_1 = 0.028 p_h \text{ [lbs/sec]} \quad \text{equation (11)}$$

where $p_h$ is the high side pressure.

Using the mass flow rate the feed forward contribution to the condensing temperature control is calculated as $$u_1 = 145 \frac{\dot{m}_1}{\Delta T_{set}} \text{Hz} \quad \text{equation (12)}$$

Figure 12:
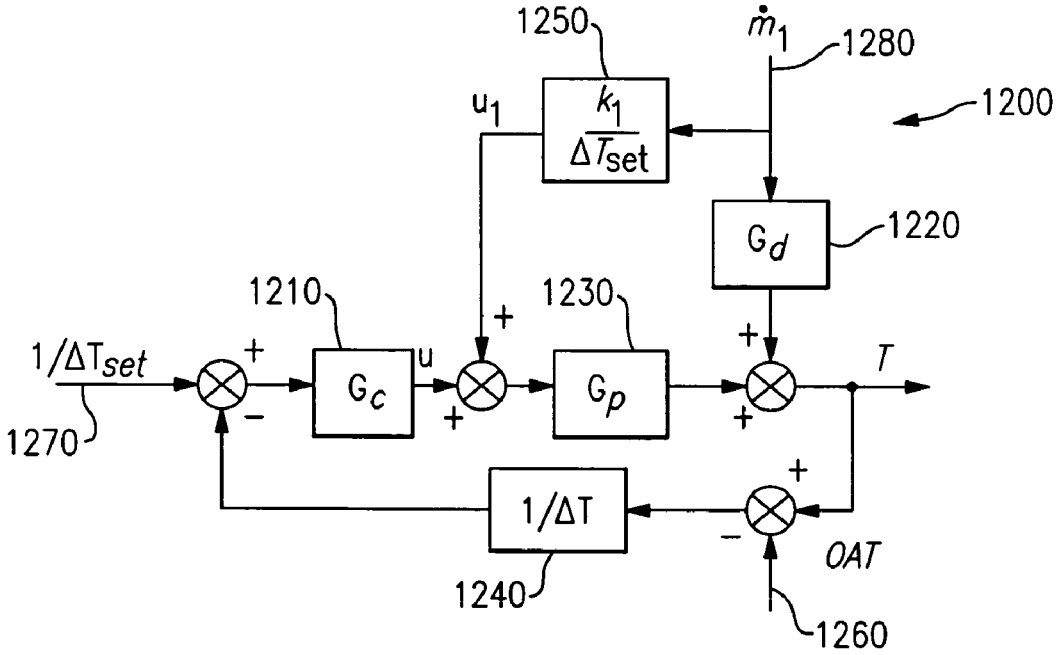
FIG. 12 is a control diagram for a feed forward implementation of principles of the invention.

The control diagram 1200 for the feedback-feedforward scheme implementation is given as in FIG. 12 where $G_c$ is the feedback PI controller 1210, $G_d$ is the plant model 1220 of the disturbance channel, and $G_p$ is the plant model 1230 for the condenser. In FIG. 12, the transfer function for the linearization is represented by the term 1/$\Delta T$ 1240, the transfer function for the application of cooling air is represented by the term $k_i/\Delta T_m$ 1250, and inputs for outdoor ambient temperature 1260, an overheat set point 1270, and a mass flow 1280 are shown.

Those of ordinary skill will recognize that many functions of electrical and electronic apparatus can be implemented in hardware (for example, hard-wired logic), in software (for example, logic encoded in a program operating on a general purpose processor), and in firmware (for example, logic encoded in a non-volatile memory that is invoked for operation on a processor as required). The present invention contemplates the substitution of one implementation of hardware, firmware and software for another implementation of the equivalent functionality using a different one of hardware, firmware and software. To the extent that an implementation can be represented mathematically by a transfer function, that is, a specified response is generated at an output terminal for a specific excitation applied to an input terminal of a "black box" exhibiting the transfer function, any implementation of the transfer function, including any combination of hardware, firmware and software implementations of portions or segments of the transfer function, is contemplated herein.

While the present invention has been explained with reference to the structure disclosed herein, it is not confined to the details set forth and this invention is intended to cover any modifications and changes as may come within the scope of the following claims.

What is claimed is:

1. A closed loop control system for an ORC, said ORC comprising a pump, said control system comprising:

a comparator that compares a superheat setpoint input and a calculated superheat value input, and provides a superheat error signal;

a superheat controller responsive to said superheat error signal, said superheat controller providing a superheat control signal;

an adder that adds said superheat control signal and a pressure signal, and provides a summed signal;

a range limiter that accepts as input said summed signal, and produces a range limited signal within a limit range;

a subtractor that subtracts from said range limited signal a duplicate of said pressure signal, said subtractor providing as output a subtracted signal; and a pressure controller that accepts said subtracted signal and produces in response thereto a pressure control signal;

whereby said closed loop control system controls a superheat of said ORC when said range limited signal is below a maximum value of said limit range, and said closed loop control system controls a pressure of said ORC when said range limited signal is at a maximum value of said range limit.

2. The closed loop control system for an ORC of claim 1, wherein a mathematical model of a pump is employed to determine whether said pump is operating in a pressure-limited regime.

3. The closed loop control system for an ORC of claim 2, wherein, in response to a determination that said pump is operating in a flow-limited regime, said control system prevents said pump from increasing a rotation speed until said pressure attains said pressure limit.

* * * * *